US005456242A

United States Patent [19]

Ruholl

[11] Patent Number: 5,456,242

[45] Date of Patent: Oct. 10, 1995

[54] ARROW REST FOR ARCHERY BOW

[76] Inventor: Eric J. Ruholl, R.R. 2, Box 1A, Teutopolis, Ill. 62467

[21] Appl. No.: 794,529

[22] Filed: Nov. 19, 1991

[51] Int. Cl.[6] ..... F41B 5/22

[52] U.S. Cl. ..... 124/44.5; 124/24.1; 124/88

[58] Field of Search ..... 124/23.1, 24.1, 124/44.5, 88, 86

[56] References Cited

U.S. PATENT DOCUMENTS

| | | | |
|---|---|---|---|
| 213,083 | 3/1879 | Wright et al. | 124/24.1 |
| 2,691,974 | 10/1954 | Nelson | 124/44.5 |
| 3,055,353 | 9/1962 | Perruci | 124/24.1 |
| 3,406,675 | 10/1968 | Fredrickson | 124/25.5 X |
| 3,455,288 | 7/1969 | Knerr | 124/24.1 X |
| 4,027,645 | 6/1977 | Damron | 124/24.1 |
| 4,282,850 | 8/1981 | Warnicke | 124/24.1 |
| 4,343,286 | 8/1982 | Thacker | 124/88 X |
| 4,351,311 | 9/1982 | Phares | 124/44.5 |
| 4,372,282 | 2/1983 | Sanders | 124/24.1 |
| 4,664,093 | 5/1987 | Nunemaker | 124/44.5 X |
| 4,759,337 | 7/1988 | Suski | 124/24.1 |
| 4,838,237 | 6/1989 | Cliburn | 124/44.5 |
| 4,858,589 | 8/1989 | Chang | 124/24.1 |
| 4,917,072 | 4/1990 | Chang | 124/44.5 |
| 5,025,773 | 6/1991 | Hintze et al. | 124/44.5 |
| 5,042,450 | 8/1991 | Jacobson | 124/24.1 X |
| 5,052,364 | 10/1991 | Martin et al. | 124/44.5 |
| 5,095,884 | 3/1992 | Mertens | 124/44.5 |

*Primary Examiner*—Randolph A. Reese
*Assistant Examiner*—John Ricci
*Attorney, Agent, or Firm*—Ronald P. Kananen

[57] ABSTRACT

An arrow rest has a guide plate defining a central opening, slots extending radially from the central opening, and a plurality of set screws projecting into the central opening to provide an adjustable support structure for arrow shafts. Magnetic stripping is provided on the inner ends of the screws to reduce sound. A mounting plate has elongate slots for mounting the guide plate to a bow in a variety of positions fore and aft with respect to the bow. An arrangement of nuts and bolts is provided to adjust the amount of lateral projection of the guide plate from the mounting plate.

7 Claims, 2 Drawing Sheets

ARROW REST FOR ARCHERY BOW

BACKGROUND OF THE INVENTION

The present invention relates to an arrow rest and, more particularly, an adjustable arrow rest for attachment to a bow.

When an arrow is placed on a bow in engagement with the string and is then drawn back and released, it is supported on the bow typically by a shoulder at the top of a hand grip. Due to its nature, the shoulder does not prevent the shaft of the arrow from sliding laterally and falling off the shoulder when the arrow is strung, drawn back or released. This deficiency in an arrow rest of the shoulder type can lead to injury, especially since many hunting arrows have heads with razor edges.

Arrow rests have been devised which surround the shaft of the arrow and have arrangements for mounting the rest to an archery bow. Such an arrow guiding device is disclosed in U.S. Pat. No. 4,372,282 to Sanders. Other arrow rests have been devised with adjustable mounting arrangements to permit the supporting portion of the rest to be positioned at various locations behind the bow depending on different pull weights. Such a rest is disclosed in U.S. Pat. No. 3,055,353 to Perrucci. However, there is no provision in the arrow rest of the Perrucci patent for lateral adjustment of the rest. Furthermore, it is important when hunting with a bow and arrow that all sound be avoided to prevent scaring off the prey. The sound of an arrow hitting its rest during the insertion of the arrow or sliding along the rest when the string is drawn back is enough to cause the prey to run off before a shot can be taken. Many prior art arrow rests have no provision to prevent sound during the insertion of an arrow.

SUMMARY OF THE INVENTION

By the present invention, an arrow rest is provided which comprises a first plate containing openings for guiding an arrow and a second plate attached to the first plate for mounting the arrow rest on a sporting bow. The guide plate defines a circular opening and slots extending radially from the opening at intervals to match the configurations of the fletches, or tail feathers, of an arrow, whereby the arrow rest holds the arrow at a particular rotational orientation with each of the tail feathers being received in one of the radial slots, the slots guiding the tail feathers as the arrow leaves the rest. The enclosing configuration of the opening maximizes control when shooting. In each of the portions of the circumference of the circular opening between the slots, adjustable supports are provided for the shaft of the arrow in the form of set screws projecting radially into the circular opening. Each of the set screws is contained in a threaded bore extending radially from the opening to an edge of the guide plate where a tool may be inserted for rotating the set screws to advance or retract them, thereby providing a peripheral guiding arrangement for the shaft which matches the diameter of the shaft. Pieces of magnetic stripping, cut into disks, are secured to the ends of the set screws, such as by gluing, so as to provide a durable, resilient, non-friction surface on which the arrows slide, the magnetic stripping also reducing the noise level as the arrow shaft engages and slides through the rest. The guide plate is releasably secured to the mounting plate by, for example, screws. The arrow rest is made of light-weight material, such as aluminum or other lightweight metal or plastic.

The mounting plate has elongate slots to permit the arrow rest to be attached to the bow with the guide plate in varying positions fore and aft of the bow. When short arrows are used, the arrow rest is mounted with the guide plate extending rearward from the bow so as to provide support for the arrow even when the arrow is fully drawn back. When longer arrows are used, the guide plate can be mounted about even with the bow, or the mounting plate can be reversed so that the guide plate is positioned at the forward end of the mounting plate and forward of the bow. The connection between the guide plate and the mounting plate is also adjustable so that the guide plate with its central opening can extend laterally farther from the mounting plate to accommodate bows of varying width.

The mounting plate is adapted to be secured to the bow at a point just above the hand grip, with the mounting plate extending either rearward or forward of the bow and the guide plate extending transversely at a right angle from the mounting plate.

BRIEF DESCRIPTION OF THE PREFERRED EMBODIMENT

Figure 1:
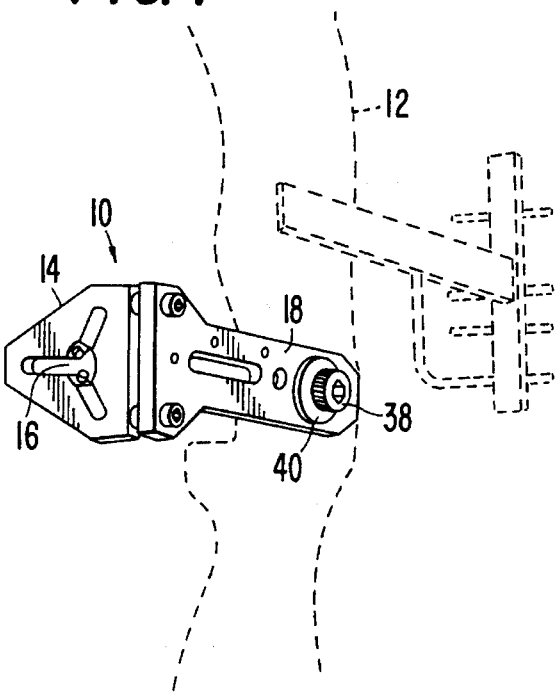
FIG. 1 is a perspective view of the arrow rest according to the present invention secured to a bow with the guide plate positioned rearward of the bow.

In FIG. 1, the arrow rest according to the present invention, which is indicated generally by the reference numeral 10, is shown secured to a bow 12. The arrow rest includes a guide plate 14 having a central opening 16 for receiving an arrow and a mounting plate 18 connected to the guide plate 14 for securing the arrow rest 10 to the bow 12.

Figure 2:
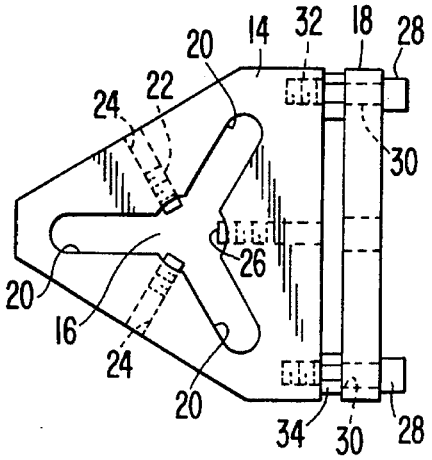
FIG. 2 is a front view of the arrow rest of FIG. 1.

As can be seen from FIG. 2, slots 20 extend radially from the central opening 16 at angles relative to one another to match the configuration of the fletches, or tail feathers, of an arrow Each of the slots 20 is elongated and has a length greater than the width of the slot. In the embodiment illustrated in FIG. 2, the slots are arranged at 120° intervals to accommodate a typical fletching on an arrow having three tail feathers. However, it is understood that other slot configurations can be provided to accommodate arrows having different numbers and orientations of tail feathers. Each of the tail feathers is received in one of the radial slots 20 when an arrow is inserted into the arrow rest 10 and when the arrow slides forward during release. Accordingly, the slots 20 serve to maintain the arrow at a particular rotational orientation.

In each of the portions of the circumference of the circular opening 16 between the radial slots 20, a set screw 22 is contained in a threaded bore 24 extending radially from the central opening 16 to an edge of the guide plate 14, where a tool such as a screw driver can be inserted for rotating the set screws 22 to advance or retract them. The radially inner ends of the set screws define within the central opening a peripheral guiding or support structure for an arrow shaft, the support structure having an effective diameter approximately equal to the diameter of the shaft. If arrows having shafts of a different diameter are to be used, the set screws 22 can be moved in or out so that their tips cooperate to define a support structure having an effective diameter approximating the diameter of the different shafts. A durable, resilient, non-friction surface is provided on the radially inner ends of the set screws 22, such as by pieces of magnetic stripping 26 cut into disks and secured to the ends of the set screws 22. The magnetic stripping 26 is the same material which is used to attach notes to a refrigerator. The material is firm and durable and has a low coefficient of friction. In addition, it is relatively silent when engaged by an arrow.

Figure 4:
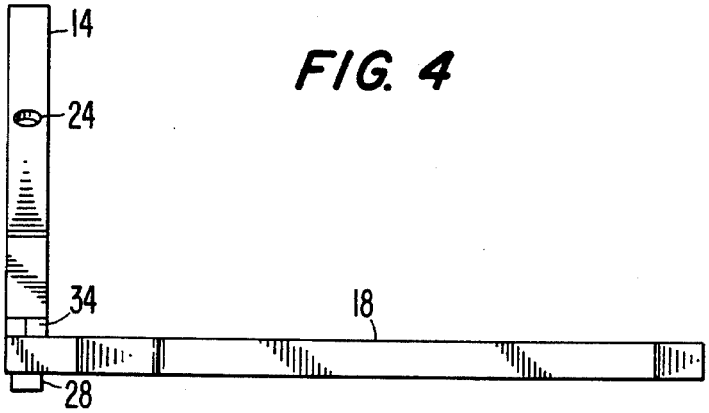
FIG. 4 is a top view of the arrow rest of FIG. 1.

The guide plate 14 is releasably secured to the mounting plate 18 at a right angle by bolts 28 extending through bores 30 through which the bolt 28 can slide and into aligned threaded bores 32 in one edge of the guide plate 14. Rotation of the bolts 28 moves them into or out of the threaded bores 32, thereby decreasing or increasing the distance by which the heads of the bolts project from the edge of the guide plate 14. Nuts 34 threadedly received on the bolts 28 are rotated to tighten the mounting plate 18 against the heads of the bolts 28. As illustrated in FIGS. 2 and 4, the lateral distance between the guide plate 14 and the mounting plate 18 is at a minimum, just the thickness of the nuts 34. From that position, the bolts 28 can be rotated to project farther from the threaded bores 32 and the nuts 34 can be rotated to tighten the mounting plate 18 against the heads of the bolts 28 so that the guide plate 14 projects laterally farther from the mounting plate 18 for use on bows which are thicker in the mounting area or have some other configuration which requires greater lateral projection for the guide plate 14.

Figure 3:
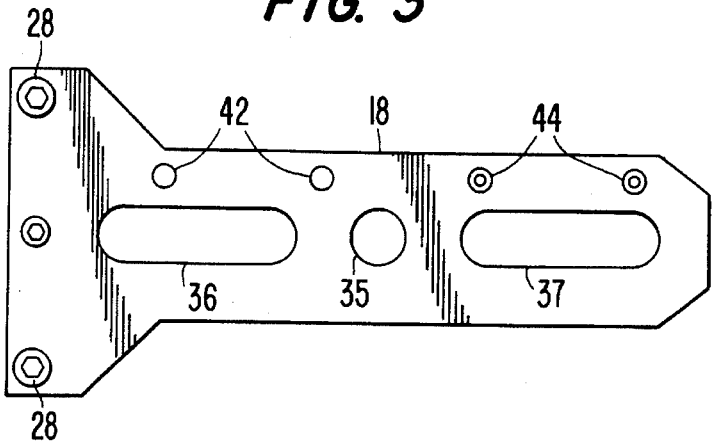
FIG. 3 is a side view of the arrow rest of FIG. 1.

The mounting plate 18 is adapted to be secured to the bow 12 at a point just above the hand grip, with the mounting plate extending either rearward or forward of the bow and the guide plate 14 extending transversely at a right angle from the mounting plate 18. As can be seen from FIG. 3, the mounting plate is provided with a circular opening 35 and, on opposite sides of the circular opening 35, elongate slots 36 and 37 for receiving a threaded fastener for securing the mounting plate 18 to the bow. Modern bows typically have a 5/16th inch fine threaded tapped hole extending laterally into the bow from just above the hand grip. The tapped hole can be used to receive a bolt 38 which, with the assistance of a washer 40, secures the mounting plate 18 on the bow 12. Instead of a bolt 38 and washer 40, the mounting plate 18 can be secured to the bow by a threaded knob or the like. The elongate slots 36 and 37 permit the arrow rest 10 to be moved fore and aft by loosening the bolt 38, moving the guide plate 18 forward or backward on the bow 12, and retightening the bolt 38. In order to prevent the arrow rest 10 from pivoting around the bolt 38, a plurality of threaded openings 42 are provided along the length of the elongate slots 36 and 37, and set screws 44 are positioned in one or more of the openings 42 and tightened against the side of the bow 12 to prevent any pivoting movement.

Figure 5:
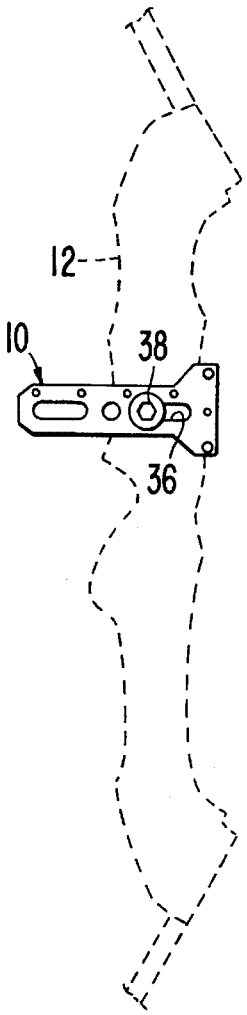
FIG. 5 is a side view of the arrow rest of FIG. 1 secured to a bow but with the guide plate positioned about flush with the bow.

In FIG. 1, the bolt 38 extends through the elongate slot 37 distal to the guide plate 14, and the mounting plate 18 projects rearward of the bow 12, with the guide plate 14 being connected at the rearward end of the mounting plate 18. In this position, the arrow rest 10 provides support for an arrow even in an overdraw position in which the head of the arrow is not forward of the bow but is even with or behind the bow. This allows the use of short, for example, 23 inch arrows which are especially suited for some purposes. In contrast, FIG. 5 shows the arrow rest 10 secured to the bow 12 with the bolt 38 extending through the elongate slot 36 and the guide plate 14 substantially even with the forward surface of the bow. This position is well suited for longer, for example, 30 inch arrows. In the FIG. 1 position and in the FIG. 5 position, the guide plate 14 extends from the mounting plate 18 across the bow 12 to support an arrow on the opposite side of the bow from the mounting plate 18. By the lateral adjustment described earlier, the guide plate 14 is adjusted laterally until the broadhead of the arrow clears the side of the bow.

With the arrow rest 10 according to the present invention, arrows are inserted from the front side of the arrow rest tail end first and drawn back. This is done to avoid cutting the bow string with the head of the arrow, many of which have razor edges.

Figure 6:
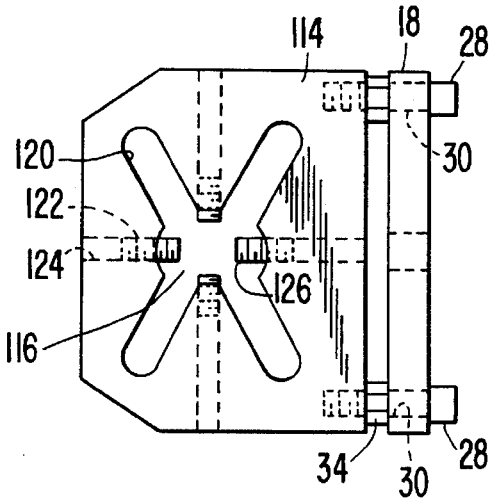
FIG. 6 is a front view of an alternate embodiment of the arrow rest according to the present invention in which a guide plate has slots to accommodate a four fletch arrow.

FIG. 6 shows an alternate embodiment of the arrow rest according to the present invention in which the guide plate 14 having three slots to accommodate the feathers of a three fletch arrow is removed and replaced with a guide plate 114 having a central opening 116 from which four slots extend generally radially at angles relative to one another to match the configuration of the fletches of a four fletch arrow. A set screw 122 is contained in each of four threaded bores 124 extending radially from the central opening 116 to an edge of the guide plate 114, and pieces of magnetic stripping 126 are secured to the interior ends of the set screws 122. The operation of the embodiment of FIG. 6 is the same as the operation of the previously-described embodiment.

It is contemplated that various modifications and alterations can be made to the embodiments of the invention described herein without departing from the spirit and scope of the present invention as defined in the appended claims.

What is claimed is:

1. An apparatus for supporting an arrow to one side of an archery bow and for guiding the arrow during release, wherein the arrow has a shaft and a plurality of tail feathers spaced from one another around the circumference of the shaft, comprising:

a guide member having a central opening for circumferentially surrounding and supporting an arrow and a plurality of slots formed in said guide member, said slots extending radially from the central opening and positioned at angles relative to one another to accommodate a plurality of tail feathers spaced from one another around the circumference of a shaft of an arrow, each of said slots being radially elongated and having a length greater than its width; and adjustable means extending radially into said central opening from said member for defining a support structure having a diameter approximately equal to the diameter of the shaft of the arrow, said adjustable means comprising a plurality of set screws; and means for preventing sound to be produced from engagement of an arrow with the apparatus;

wherein the sound preventing means comprises antifriction material secured to the radially inner ends of the set screws for engaging the shaft of an arrow.

2. Apparatus for supporting an arrow on an archery bow and for guiding the arrow during release, wherein the arrow has a shaft and tail feathers spaced from one another around the circumference of the shaft, comprising:

a guide member having a central opening and slots extending radially from the central opening at angles relative to one another to accommodate a plurality of tail feathers spaced from one another; and adjustable means extending radially into said central opening from said member for defining a support structure having a diameter approximately equal to the diameter of the shaft of the arrow, said adjustable means comprising a plurality of set screws; and means for preventing sound to be produced from engagement of an arrow with the apparatus;

wherein the sound preventing means comprises antifriction material secured to the radially inner ends of the set screws for engaging the shaft of an arrow; and wherein said anti-friction material comprises magnetic stripping.

3. The apparatus of claim 2, further comprising a mounting member, and means for connecting the guide member to the mounting member in a plurality of positions spaced different distances from the mounting member.

4. The apparatus according to claim 3, wherein said connecting means comprises threaded openings in said guide member, threaded bolts engaged in said threaded openings, openings extending through said mounting member, said mounting member openings receiving said bolts such that said mounting member is positioned between said guide member and the heads of said bolts, and lock nuts positioned on said bolts between said guide member and said mounting member for securing said mounting member against the heads of said bolts.

5. The apparatus of claim 2, wherein said guide member defines threaded bores extending radially from said circular opening to an edge of said member, said set screws being recessed from the edge end of said threaded bore.

6. An apparatus for supporting an arrow to one side of an archery bow and for guiding the arrow during release, wherein the arrow has a shaft and a plurality of tail feathers spaced from one another around the circumference of the shaft, comprising:

a guide member having a central opening for circumferentially surrounding and supporting an arrow and a first plurality of elongated slots formed in said guide member, said slots extending radially from the central opening at angles relative to one another and positioned to accommodate a plurality of tail feathers spaced from one another about the circumference of a shaft of the arrow;

adjustable means extending radially into said central opening from said member for defining a support structure having a diameter approximately equal to the diameter of the shaft of the arrow, said adjustable means comprising a plurality of set screws projecting into said central opening and free from interference with openings in said elongated slots; and a mounting member attached to said guide member, said mounting member having a second plurality of elongate slots for attaching the apparatus in varying positions relative to the bow.

7. The apparatus of claim 6, wherein said mounting member has threaded openings adjacent to said second plurality of elongate slots and set screws positioned in said threaded openings for engaging a portion of said bow adjacent to said second plurality of elongate slots to prevent movement of said apparatus relative to the bow.

* * * * *